US006544705B2

(12) United States Patent
Kim et al.

(10) Patent No.: US 6,544,705 B2
(45) **Date of Patent: *Apr. 8, 2003**

(54) MICRO-SERRATED, DYED COLOR TONER PARTICLES AND METHOD OF MAKING SAME

(75) Inventors: Chul-Hwan Kim, Daejon (KR); Eui-Jun Choi, Ahnyang (KR); Tae-Ho Park, Daejon (KR); Seok-Jin Kim, Seoul (KR); Hyun-Nam Yoon, Towaco, NJ (US)

(73) Assignee: DPI Solutions, Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/860,953

(22) Filed: May 18, 2001

(65) Prior Publication Data

US 2002/0182527 A1 Dec. 5, 2002

(51) Int. Cl.[7] ..... G03G 9/087

(52) U.S. Cl. ..... 430/109.4; 430/110.3; 430/110.4; 430/137.1

(58) Field of Search ..... 430/110.3, 110.4, 430/109.4, 109.3, 137.1

(56) References Cited

U.S. PATENT DOCUMENTS

| | | | | |
|---|---|---|---|---|
| 2,297,691 A | | 10/1942 | Carlson | 95/5 |
| 3,590,000 A | | 6/1971 | Palermiti et al. | 252/62.1 |
| 4,100,087 A | * | 7/1978 | Takayama et al. | 430/111.4 |
| 4,298,672 A | | 11/1981 | Lu | 430/108 |
| 4,338,390 A | | 7/1982 | Lu | 430/106 |
| 4,645,727 A | | 2/1987 | Ong et al. | 430/106 |
| 4,778,742 A | | 10/1988 | Ong et al. | 430/106 |
| 4,880,432 A | | 11/1989 | Egan et al. | 8/647 |
| 4,968,577 A | * | 11/1990 | Kohri et al. | 430/110.3 |
| 5,102,761 A | | 4/1992 | Ohsaki et al. | 430/106 |
| 5,114,821 A | | 5/1992 | Haack | 430/110 |
| 5,200,290 A | | 4/1993 | Ong et al. | 430/115 |
| 5,212,033 A | | 5/1993 | Tsubota et al. | 430/106 |
| 5,227,460 A | | 7/1993 | Mahabadi et al. | 528/272 |
| 5,296,325 A | | 3/1994 | Ohtsuka et al. | 430/106 |
| 5,352,521 A | | 10/1994 | Hotta et al. | 428/402 |
| 5,376,494 A | | 12/1994 | Mahabadi et al. | 430/137 |
| 5,437,953 A | | 8/1995 | Russell et al. | 430/106 |
| 5,470,687 A | | 11/1995 | Mayama et al. | 430/137 |
| 5,500,321 A | | 3/1996 | Kasuya et al. | 430/109 |
| 5,565,298 A | | 10/1996 | Suguro et al. | 430/137 |
| 5,693,444 A | | 12/1997 | Takagi et al. | 430/106.6 |
| 5,866,662 A | | 2/1999 | Hatke et al. | 526/160 |
| 6,001,524 A | | 12/1999 | Yoon et al. | 430/106 |
| 6,156,473 A | | 12/2000 | Tyagi et al. | 430/137 |
| 6,287,742 B1 | | 9/2001 | Yoon | 430/137.19 |

FOREIGN PATENT DOCUMENTS

| | | | | |
|---|---|---|---|---|
| GB | 1373531 | | 11/1974 | C08G/20/02 |
| JP | 61279864 A | * | 12/1986 | 430/110.3 |
| JP | 3-121466 | | 5/1991 | G03G/009/087 |
| JP | 04338974 A | * | 11/1992 | 430/110.3 |
| JP | 5-134458 | | 5/1993 | G03G/009/087 |

OTHER PUBLICATIONS

Webster's II New Riverside Dictionary. Boston: Houghton Mifflin Co. p. 1066 (1984).*

Dyes and Pigments 13. The Role of Organic Molecules in Colour Hard Copy. pp. 251–268. (1990).*

(List continued on next page.)

*Primary Examiner*—Christopher Rodee
(74) *Attorney, Agent, or Firm*—Michael W. Ferrell

(57) ABSTRACT

A color toner composition includes dyed toner resin particles having a volume average diameter in the range of from about 2 microns to about 10 microns with a size distribution span value of less than 1.0. Preferred particles are characterized further by a micro-serrated surface exhibiting a roughness index value larger than about 1.2. The resin toner particles are prepared utilizing a dye-mediating co-solvent which facilitates transfer from a dispersion medium to the resin particles.

11 Claims, 2 Drawing Sheets

OTHER PUBLICATIONS

Diamond, Arthur S. (editor) Handbook of Imaging Materials. New York: Marcel–Dekker, Inc. pp. 168, 178, 199. (1991).*

Powder Technology Handbook, 2nd edition, Marcell Dekker Publications (1997), pp. 3–13 by K. Gotoh et al.

Physical Chemistry of Surfaces, 6th edition, by A.W. Adamson and A.P. Cast (1997), John Wiley and Sons, NY, NY.

Aldrich Handbook of Fine Chemicals and Laboratory Equipment 2000–2001, Milwaukee, p. 1372.

Polymer Science Dictionary, London: Elsevier Applied Science, pp. 361 and 385, by Mark S.M. Alger; and Chemical Abstract Registry Numbers 17418–58–5, 31810–89–6 and 6439–53–8.

U.S. Ser. No. 09/457,543, filed Dec. 9, 1999, entitled "Method of Producing Toner for Developing Latent Electrostatic Images by Way of Dispersion Dyeing", of H–N Yoon.

* cited by examiner

MICRO-SERRATED, DYED COLOR TONER PARTICLES AND METHOD OF MAKING SAME

CROSS-REFERENCE TO RELATED APPLICATIONS

The subject matter of this application relates generally to that disclosed in U.S. patent application Ser. No. 09/457,543 filed Dec. 9, 1999, now U.S. Pat. No. 6,387,583 as well as to the inventions disclosed in concurrently filed U.S. patent application Ser. No. 09/860,959, filed May 18, 2001 entitled MICRO-SERRATED COLOR TONER PARTICLES AND METHOD OF MAKING SAME, now U.S. Pat. No. 6,461,783 and U.S. patent application Ser. No. 09/860,960, filed May 18, 2001, entitled MICRO-SERRATED PARTICLES FOR USE IN COLOR TONER AND METHOD OF MAKING SAME. The disclosure of the foregoing applications are incorporated herein by reference.

TECHNICAL FIELD

This invention generally relates to toner compositions and a dispersion dyeing method of producing toners for developing latent electrostatic images in electrophotography, electrostatic recording and electrostatic printing. More specifically, this invention relates in preferred embodiments to micro-serrated dyed color toner compositions and a co-solvent-mediated dispersion dyeing method of suitably sized resin particles to form toner particles for high-resolution electrophotography, electrostatic recording and electrostatic printing.

BACKGROUND OF THE INVENTION

The formation and development of images on the surface of photoconductive materials by electrostatic means is well known. The basic electrophotographic imaging process (U.S. Pat. No. 2,297,691) involves placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic toner material. The toner will normally be attracted to those areas of the photoreceptor which retain a charge, thereby forming a toner image corresponding to the electrostatic latent image. This developed image may then be transferred to a substrate such as paper. The transferred image subsequently may be permanently affixed to the substrate by heat, pressure, a combination of heat and pressure, or other suitable fixing means such as solvent or overcoating treatment.

Toners and developer compositions including colored particles are well known. Electrostatic images formed on an electrophotographic photoconductor and an electrostatic recording medium are generally developed by using (i) a mono-component toner composition comprising a binder resin, a coloring agent such as a dye or pigment and a charge control agent thereto when necessary or (ii) a two-component type developer composition comprising a toner composition blended with solid carrier particles. Some U.S. patents in this regard are U.S. Pat. Nos. 5,352,521, 4,778,742, 5,470,687, 5,500,321, 5,102,761, 4,645,727, 5,437,953, 5,296,325 and 5,200,290. The traditional compositions normally contain toner particles consisting of resin and colorants, wax or a polyolefin, charge control agents, flow agents and other additives. A typical toner formulation generally contains about 90–95 weight percent resin, about 2–10 weight percent colorant, from about 0 to about 6 weight percent wax, from about 0 to about 3 weight percent charge control agent, about 0.25–1 weight percent flow agent and from about 0 to about 1 weight percent other additives. Major resins are styrene-acrylic copolymers, styrene-butadiene copolymers and polyesters. The colorants usually are selected from cyan dyes or pigments, magenta dyes or pigments, yellow dyes or pigments, and mixtures thereof.

One of the main advantages of selecting organic dyes instead of pigments for color toner compositions resides in the provisions of increased color fidelity as the dyes can be molecularly dispersed in the toner resins. To obtain a homogeneous dispersion, it is generally necessary to build into these molecules certain substituents for enhancing their compatibility with the toner resin. Unless the dye molecules are substantially fully compatible with the toner resins, they have a tendency to aggregate with time, especially when subjected to heat, pressure and humidity thereby resulting in a loss of color fidelity. Additionally, the low molecular weight of the dye molecules causes a high lability or mobility of the dye molecules in the toner resin resulting in undesirable bleeding of the dyes.

An attempt for improvement is to incorporate a dye into preformed resin particles by dispersing the particles in a dye solution and diffusing the dye into the central portion of each resin particle. For example, U.S. Pat. No. 5,565,298 discloses a method of producing toner particles comprising of a copolymer of styrene and n-butyl methacrylate formed by a suspension polymerization method and dyed by dispersing in a bath comprising of a dye and methanol as solvent. However, the method has several deficiencies that make it unsuitable for producing high-resolution toner particles. The dyeing has to be carried out below the glass transition temperature of the resin and it therefore takes a long dyeing time. Particles also tend to coagulate in the course of dyeing resulting in a large average particle size and a broad size distribution. Incorporating a sufficient amount of dyes for vivid color image is difficult due to a limited solubility of dyes in polymer resins. Dyes tend to migrate out of the particle during storage and evaporate during the fixing stage of electrophotography process, severely interfering with operation of electrophotography equipment.

A dispersion dyeing process for particulate resin is disclosed in a co-pending patent application, Ser. No. 09/457,543. The invention provides a method of producing high-resolution color toner by dispersing resin particles and a dye in a bath and effecting the dye molecules to be absorbed in the central portion of each resin particle while substantially maintaining the size and size distribution of the resin particles. The polymer resin contains functional groups in its molecular structure for interacting with a functionalized dye in order to effect a deep dyeing as welt as to bind to enhance dye fastness. The bath comprises an organic solvent which is immiscible with the polymer resin and a non-ionic surfactant. The surfactant not only prevents the resin particles from coalescing but provides a solubility of the dye so that dyeing can be effected. There are, however, several disadvantages associated with the invention. Dyes usable for the invention are limited to the ones that have solubility in the surfactants. Furthermore, the functionalized dyes generally are not soluble in the organic solvents used in the invention and have a very limited solubility in the surfactants. The dyeing process therefore is slow and has to be carried out at an elevated temperature which is typically about 40° C. above the glass transition temperature of the resin. As a result, the toner particles produced by the process tend to have a spherical shape and a smooth surface texture. Consequently, the toner composition of the invention tends to have a slow triboelectric charging characteristic and is not advantageous for use in a mono-component electrophotographic development system.

There is continuing interest in the development of new and improved methods of producing toners for application in high-resolution color electrophotography.

Accordingly, an object of the present invention is to provide a method of producing high-resolution color toner which has a superior combination of properties for electrophotographic imaging systems by dispersing resin particles and a dye in a bath comprising an organic solvent, a surfactant and a dye-mediating co-solvent and expeditiously effecting the dye molecules to be absorbed in the central portion of each resin particle while substantially maintaining the size and size distribution of the resin particles as well as desirable surface properties.

Another object of the present invention is to provide a method of producing high-resolution toner of which toner particles are substantially spherical and have micro-serrated surface texture.

Yet another object of the present invention is to provide a high-resolution color toner composition of which particles are spherical in shape with a diameter in the range of about 1 to 10 microns, have a narrow size distribution and have a micro-serrated surface texture.

Other objects and advantages of the present invention shall become apparent from the accompanying description and examples.

SUMMARY OF INVENTION

There is provided in accordance with the present invention a color toner composition including dyed resin particles having a volume average diameter in the range of from about 2 to about 10 microns with a size distribution span value of less than 1.0 and a micro-serrated surface texture. Generally, the particles exhibit a surface roughness index value of greater than about 1.2. Surface roughness index values of greater than about 1.5 or about 2.0 or more may readily be achieved if so desired.

There is provided in accordance with another aspect of the present invention a process of preparing a toner for developing latent electrostatic images comprising: dispersing a particulate polymer resin with functional sites suitable for interacting with a functionalized dye in a liquid organic medium; the organic medium comprising an organic solvent or dispersion medium, a surfactant, and a dye-mediating co-solvent; the polymer being substantially insoluble in the organic dispersion medium; providing a functionalized dye to the organic medium wherein the functionalized dye has functional sites adapted for interacting with the functional sites on the particulate polymer resin; maintaining the organic medium containing the particulate resin for a time sufficient to dye the resin and separating the organic medium from the particulate polymer resin. The functionalized dye is thus applied to the resin particles and the particle size of the particulate polymer resin is substantially unchanged during the dyeing process recited above.

Any suitable polymer resin for toner application may be used. The polymer resin may have functional sites suitable for interacting with a functionalized dye selected from the group consisting of: hydroxyl moieties; alkoxyl moieties; sulfonic or derivatized sulfonic moieties; sulfonic or derivatized sulfonic moieties; carboxyl or derivatized carboxyl moieties; phosphonic or derivatized phosphonic moieties; phosphinic or derivatized phosphinic moieties; thiol moieties, amine moieties; alkyl amine moieties; quaternized amine moieties; and mixtures thereof.

In typical embodiments the particulate polymer resin has a volume average particle size of from about 2 to about 10 microns. The particulate polymer resin preferably has a volume average particle size of from about 3 to about 8 microns. It is generally preferred that the particulate polymer resin has a narrow size distribution with the 80% span (the "span") less than 1.0, the 80% span being defined as the ratio of the middle size range in which 80% of the particles exist to the volume average particle size. More preferably, the span is less than 0.8.

A particularly desirable and surprising aspect of the present invention is that the toner particles may be made to have an irregular surface texture that increases the surface area and thus substantially improves the triboelectric charging characteristics of the toner composition especially the charging speed. A fast triboelectric charging toner composition is particularly desirable when the toner composition is used in a mono-component development systems which are widely employed in desktop laser printers. Desired level of the irregular surface texture of the toner particles may be characterized by the surface roughness index greater than 1.2, the surface roughness index being defined as the ratio of surface areas of the irregular textured particles and smooth texture particles.

In general, it may be possible to achieve surface roughness indices of greater than 1.2 or so and up to as high as 5 or more and span values of the particle size distribution of less than 0.8 down to 0.5 or even 0.2.

Any suitable method may be employed to prepare the particulate resin composition. Some of the typical methods are; air jet milling, dispersion polymerization and, more preferably, and dispersion comminution. The dispersion comminution process is preferred because the particle produced with the process may have a micro-serrated surface texture and therefore a faster triboelectric charging behavior.

Any suitable dye may be used in the practice of the present invention so long as it can be bound to the particulate polymer resin. Preferred dyes include basic dyes, acid dyes, or reactive dyes. The weight ratio to dye to particulate polymer resin is generally from about 1:100 to about 10:100 or from about 1 to about 10 percent by weight.

Any organic solvent that does not dissolve the polymer resin may be used in the present invention. The immiscibility between the solvent and the resin may be assured by selecting the solvent (i.e., organic dispersion medium) with a solubility parameter different from that of the resin. The solubility parameter value of the organic solvent is different than the solubility parameter value of the particulate polymer resin by at least about 1. More preferably the solubility parameter of the organic solvent is different than the solubility parameter value of the particulate polymer resin by at least about 2. Particularly preferred are paraffinic solvents.

A surfactant is preferably included in the inventive process. Most preferred are non-ionic surfactants as detailed further herein. Especially useful non-ionic surfactants include copolymers of vinylpyrrolidinone, copolymers containing ethylene oxide moieties or propylene oxide moieties.

The surfactant may be present in an amount of from about 5 to about 200 percent by weight of the amount of organic solvent present in the organic medium, whereas from about 10 to about 50 percent is more typical with from about 20 to about 40 weight percent of surfactant being preferred.

Any solvent that has some solubility of the functionalized dye may be used as the dye-mediating co-solvent. However, it is preferable for the dye-mediating co-solvent or dyeing assistive to be soluble in the surfactant for expeditious dyeing and has a limited solubility of less than about 5 percent by weight in the polymer resin to insure that there is no agglomeration of the particles during dyeing. Furthermore, a dyeing assistive with a low boiling temperature below about 100° C. is preferred so that the dyeing operation may be carried out at a low temperature and thereby the micro-serrated surface texture may be retained after the dyeing operation. Examples of the preferred dyeing assistives are; ethyl alcohol; propyl alcohol; acetone; tetrahydrofuran; methyl ethyl ketone; butanone; water and a combination thereof. Any suitable co-solvent may be employed provided it has some miscibility with both the dye and resin of the particles.

The dye-mediating co-solvent may be present in an amount of from about 1 to about 30 percent by weight of the amount of organic solvent present in the organic medium, whereas from about 5 to about 20 percent is preferred.

It is likewise preferred to operate the inventive process at relatively high solids content wherein the polymer resin is present in an amount of from about 10 to about 70 volume percent of the combined volume of resin and organic medium during dying. From about 20 to about 40 volume percent resin is perhaps more typical in some embodiments.

The elevated temperature at which the process of the invention is carried out is generally lower than 30° C. more than the glass transition temperature of the resin being dyed. For example, a resin having a glass transition temperature of 80° C. is dyed at a temperature lower than about 110° C. During the dyeing process the organic medium is maintained at an elevated temperature which is typically close to the glass transition temperature of the particulate polymer resin so that the dye and the charge control agent can readily penetrate the resin without substantially altering the surface texture of the resin particles. Particularly preferred in some embodiments is an elevated temperature the same as glass transition temperature of the polymer resin. Typically the polymer is dyed for at least five minutes and in many embodiments between about 5 and about 60 minutes.

A charge control agent is preferably added during the step of dyeing the particulate resin so as to simplify processing. Charge control agents are discussed in more detail hereinafter.

There is provided in still another aspect of the present invention a dispersion dyed color toner for developing latent electrostatic images. The inventive toner is prepared by a process including dispersing a particulate polymer resin provided with functional sites suitable for interacting with a functionalized dye in a liquid organic medium comprising an organic solvent, a surfactant and a dyeing assistive, the polymer being substantially insoluble in the organic solvent; providing the functionalized dye to the organic medium, wherein the functionalized dye has functional sites adapted for interacting with the functional sites on the particulate polymer resin; maintaining the organic medium, containing the particulate polymer resin and the dye at an elevated temperature for a time sufficient to dye the resin; and separating the organic medium from the particulate polymer resin. The functionalized dye is thus applied to the resin particles and the particle size of the particulate polymer resin is substantially unchanged during the process of preparing the toner.

Preferably, the toner particles are substantially spherical, have the volume average diameter in the range of from about 2 microns to about 10 microns, have a narrow size distribution with the span value less than 1.0 and further have micro-serrated surface texture characterized by the surface roughness index value larger than 1.2.

In most embodiments the color toner also includes a charge control agent present in an amount from about 0.1 weight percent to about 10 percent by weight of the toner. The toner may optionally include a flow improvement agent such as fumed silica.

There may be prepared developer compositions comprising the dispersion dyed color toner of the present invention. The developer composition includes the toner and carrier particles selected from the group consisting of ferrite particles, steel powder, iron powder and the like having a surface active agent coated therein. Examples of suitable carrier composition are described in U.S. Pat. No. 5,693,444, the disclosure of which is incorporated herein by reference.

BRIEF DESCRIPTION OF DRAWINGS

The invention is described in detail below with reference of the various Figures wherein.

DETAILED DESCRIPTION OF THE PREFERRED EMBODIMENTS

Figure 1:
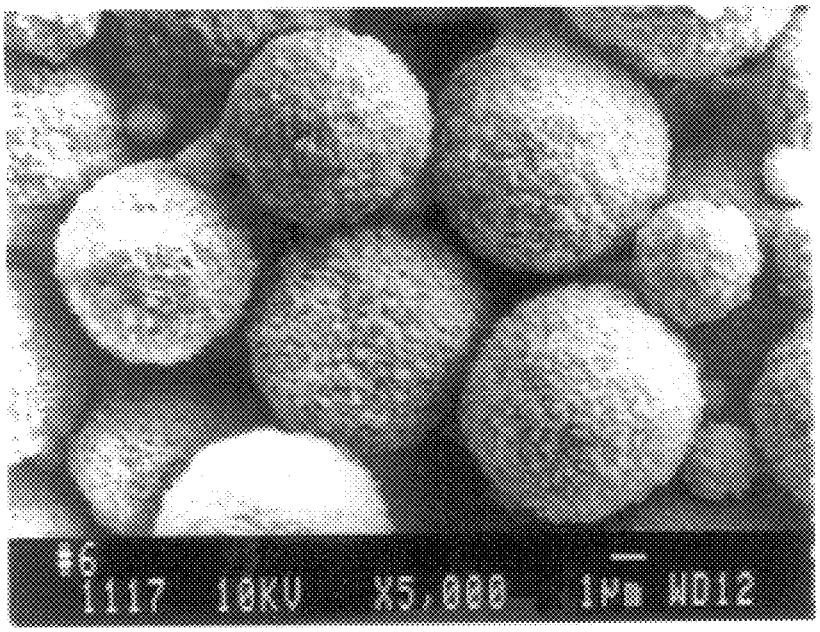
FIG. 1 is a scanning electron micrograph of a toner composition including particles which have a micro-serrated surface texture.

As the resins for preparing toner particles for thermal image fixing, the conventionally known resins such copolymers of styrene and acrylate and polyesters. Furthermore, the resins, suitable for the inventive process, are chemically modified to contain one or more reactive functionalities in about 1–10 mole percent amounts. The reactive functionalities are chosen as to be reactive toward suitable dyeing reagents either by a covalent bonding or by ionic complexing mechanism. Examples of the functional groups include, but are not limited to, the moieties hydroxyl, alkoxy, sulfonic or derivatized sulfonic, sulfinic or derivatized sulfinic, carboxyl or derivatized carboxyl, phosphonic or derivatized phosphonic, phosphinic or derivatized phosphinic, thiol, amine, alkylamine and quaternized amine and combinations thereof, e.g., $—SO_3M$, O—COOM, $—P(=O)(OM)_2$, $—P(=O)R(OM)$, —OH, —OR, $—NR_1R_2R_3N$, —NHR and —SH, where R, $R_1$, $R_2$ and $R_3$ are alkyl groups, M is a metal group and N is an anion.

In the present invention, it is preferable to use small resin particles which have a volume average particle size in the range 2–10 $\mu$m. The terms "volume average particle size" is defined in, for example, Powder Technology Handbook, 2nd edition, by K. Gotoh et al, Marcell Dekker Publications (1997), pages 3–13. More specifically, it is preferable to use a particulate resin composition of which particles are substantially spherical, have a volume average diameter in the range from about 3 microns to about 5 microns, have a narrow particle diameter distribution with the span value less than 1.0, more preferably less than 0.8. This is because the resin particles with such a narrow particle size distribution provide toner particles which are uniformly dyed, have uniform quantity of electric charge in each toner particle, and can provide high-quality copy images and for which charge control is easy in a development unit.

Particle size distribution is determined using a commercially available Coulter LS Particle Size Analyzer (made by Coulter Electronics Co., Ltd., St. Petersburg, Fla.). The data are often represented by the cumulative volumetric diameter distribution diagram in which the volume fraction (or the percent by volume) of the particles with the diameter less than a value is plotted against the diameter value. It was stated earlier that the span is a measure of the narrowness of the diameter distribution and is defined as the ratio of the diameter range in which the middle 80 percent by volume of the particles occupy to the median diameter. More specifically. the span is defined by the formula:

$$\text{Span}=(d_{90}-d_{90})/d_{50}$$

Here $d_{10}$ is the diameter value at which the volume fraction is 10 percent by volume in the cumulative volumetric diameter distribution diagram, $d_{90}$ the diameter value at which the volume fraction is 90 percent and $d_{50}$ the diameter value at which the volume fraction is 50 percent. Therefore, a smaller span value means a narrow distribution of the particle diameter.

The desired particulate resin of suitable particle shape and size may be prepared from the above-noted components by a variety of techniques. In order to prepare resin particles with the above-mentioned average particle size and narrow particle size distribution, a dispersion polymerization method, in particular, the dispersion polymerization method disclosed in British Patent 1,373,531, is suitable. The disclosure of the '531 patent is incorporated herein by reference. Generally in a typical dispersion process, polymerizable monomers, an initiator and a dispersion stabilizer are dispersed in a solvent which is immiscible with the monomers. Under a vigorous shearing action, the monomers are finely dispersed as small droplets in the solvent and the droplets are stabilized without coalescence by the presence of the stabilizer molecules on their surface. The dispersion is then heated to an initiation temperature and the polymerization proceeds in each droplet. After a specified polymerization period, the reaction mixture is cooled to ambient temperature and polymer particles are separated by filtration for further processing. In the process, the particle size is controlled by the amount of added stabilizer and the shearing. The molecular weight of the polymer is controlled by the initiator amount and/or the polymerization time.

Optionally, the resin particles may be prepared by a milling process commonly used in preparing conventional toners and described, for example, in U.S. Pat. No. 5,102,761. In that process, a polyester resin is mechanically crushed, milled into small particles and then classified to obtain particles with desired particle size and size distribution.

It is particularly preferable to use small resin particles which are substantially spherical, have a volume average particle diameter in the range of 2–10 $\mu$m, have a narrow diameter distribution with the span less than 1.0 and further have a micro-serrated surface texture characterized by the surface roughness index greater than 1.2. An irregular surface texture of toner particles increases the surface area and thus substantially improves the triboelectric charging characteristics of the toner composition such as the charging speed. A fast triboelectric charging characteristic of a toner composition is particularly important when the toner composition is used in a monocomponent development systems which are widely employed in desktop laser printers.

The surface area of particulate resin and toner compositions is determined from the BET adsorption isotherm measurement. The BET isotherm is measured using a commercially available Automatic Volumetric Sorption Analyzer (Model No. ASAP2000, Micromeritics Instrument Corporation, Norcross, Ga.). In the measurement, the amount of adsorptive ($N_2$ in our case) adsorbed on the particle surface at a reduced pressure is determined. The surface area is estimated from a plot of the adsorptive amount relative to the pressure. A detailed description of the experimental method and the theoretical basis of the BET adsorption isotherm may be found in pp. 615–631, "Physical Chemistry of Surfaces,"$6^{th}$ edition, by A. W. Adamson and A. P. Cast (1997), John Wiley and Sons, NY, N.Y.

The surface roughness index used in the present invention is defined as the ratio of surface area ($A_{exp}$) of 1 gram of the particulate composition as determined by the BET isotherm method to the surface area of 1 gram of hypothetical spherical particles which have a perfectly smooth surface and also have a uniform distribution of diameter that is equal to the volume average diameter ($d_v$) of the actual particulate resin. The surface roughness index may then be represented by the formula:

$$\text{Surface roughness index}=(1/6)\rho d_v A_{exp}$$

where $\rho$ is the density of the polymer resin. The index is a measure of how increased the surface area is due to surface roughness.

The desired particulate resins with suitable shape, size and the micro-serrated texture may be produced by a dispersion comminution process as disclosed in a co-pending U.S. patent application Ser. No. 09/860,959 entitled MICRO-SERRATED PARTICLES FOR USE IN COLOR TONER AND METHOD OF MAKING SAME, the disclosure of which is incorporated herein by reference.

The advantage of these resin particles is that they can be directly dyed by appropriately reacting the functionalities on the polymer with appropriate coloring reagents. The coloring reagent is typically a dye which may be a basic dye, acid dye, reactive dye and combinations thereof. Basic dyes are cationic molecules which ionically bind to anionic sites. Acid dyes are anionic molecules which bind to cationic or basic sites, while reactive dyes are functional molecules which contain groups that covalently bind to sites such as, for example, —OH, —SH or —NRH in order to form respectively an ether, thioether or amine linkages.

The weight ratio of the dye to the resin to be dyed can be selected as desired, depending upon the desired color tone. However, generally it is preferable that the amount of the dye is in the range of 1 to 10 parts by weight to 100 parts by weight of the resin particles to be dyed.

It is preferable to employ an organic solvent in which the resin particles are not soluble. More specifically, it is preferable that the solubility parameter value of the solvent is different than that of the resin particles by 1.0 or more, more preferably 2.0 or more. For example, it is preferable to employ a non-polar organic solvent having a low solubility parameter value such as paraffins, paraffinic esters, paraffinic amides and paraffinic ethers in combination with the polyester resin particles. In contrast, when a highly polar solvent such as water, methanol, propanol, and acetone is employed as a solvent for the dyeing process, significant coalescence of the particles occurs.

Particularly preferred organic solvents (or perhaps more accurately, organic dispersion media) for use in connection with the invention are paraffins. Examples of paraffins are normal and isoparaffins with 7 or more carbon atoms such as: octane, decane, dodecane, and isoparaffinic mixtures sold under the name "Isopar®" by Exxon Chemical Company, Houston, Tex. Grades and their carbon numbers are as follows: Isopar® C C7-8; Isopar® E, C8-9; Isopar® G C10-11; Isopar® H C11-12; Isopar® K C11-12;Isopar®LC11-13;Isopar® MC13-14; and Isopar®VC112-40. These Isopars® are manufactured by distillation and each designation refers to the take off positions of a distillation column. Also suitable for organic solvent to be utilized in the dyeing process of the present invention are mineral oils which are mixtures of paraffins. So also paraffinic esters such as dodecyl acetate may be employed; whereas paraffinic amides such as decylamine may also be employed.

A surfactant is used in conjunction with the aforementioned non-polar solvent in the dyeing operation of this invention. It prevents coalescence of the resin particles during the dyeing reaction. In the inventive process, dyeing is carried out generally at a temperature close to the glass transition temperature of resin. Thus, in the absence of the surfactant, the particles are in the molten state, tend to coalesce in an uncontrollable manner and produce dyed particles which are unsuitable as a high-resolution toner. The surfactant may be anionic, cationic or non-ionic. It is preferable that the surfactant is non-ionic.

The weight ratio of the surfactant to the organic solvent can be selected as desired depending on the amount of the resin particle to be dyed and the required processing time. However, generally it is preferable that the amount of the surfactant is in the range of 5 to 200 parts by weight to 100 parts by weight of the organic solvent. From about 10 to about 40 percent by weight of surfactant is somewhat typical, based on the weight of solution. The amount of the total liquid medium in dye bath to the resin to be dyed can be selected as desired. However, generally it is preferable that the amount of the solvent is in the range of 50 to 1000 parts by weight to 100 parts by weight of the resin particles to be dyed.

Examples of useful classes of non-ionic surfactants include alkylphenol ethoxylates, aliphatic alcohol ethoxylates, fatty acid alkoxylates, fatty alcohol alkoxylates, block copolymers of ethylene oxide and propylene oxide, condensation products of ethylene oxide with the product resulting from the reaction of propylene oxide, copolymers of vinylpyrrolidinone and ethylenediamine and condensation products of propylene oxide with product of the reaction of ethylene oxide and ethylenediamine. Particularly useful surfactants include the reaction product of a fatty acid or a fatty alcohol with ethylene oxide such as a polyethylene glycol diester of a fatty acid (PEG diols or PEG diesters).

Any solvent that dissolves the functionalized dye by more than about 2 percent by weight may be used as the dyeing assistive or dye-mediating co-solvent as sometimes it is referred to herein. However, it is preferable for the dyeing assistive to be soluble in the surfactant for expeditious dyeing and has a limited solubility of less than 5 percent by weight in the polymer resin to insure that there is no agglomeration of the particles during dyeing. Furthermore, a dyeing assistive with a low boiling temperature below about 100° C. is preferred so that the dyeing operation may be carried out at a low temperature and thereby the micro-serrated surface texture may be retained after the dyeing operation. Examples of the preferred dyeing assistives are; ethyl alcohol; propyl alcohol; acetone; tetrahydrofuran; methyl ethyl ketone; butanone; water and a combination thereof.

The dyeing assistive may be present in an amount of from about 1 to about 30 percent by weight of the amount of organic solvent present in the organic medium, whereas from about 5 to about 20 percent is preferred.

In the present invention, the dyeing is carried out, for example, by dispersing an appropriate functional dye in the organic medium comprising an organic solvent, a surfactant and a dyeing assistive then dispersing the resin particles in the bath and stirring the dispersion at a temperature close to the glass transition temperature of the resin. The temperature ensures the penetrating rate of the dye into the resin particles to be sufficiently high that dyed resin particles can be obtained in about 5 minutes to about 60 minutes and yet maintains the surface texture of the particles. For agitating the dispersion of the dye and resin particles, a conventional stirrer such as a blade-type mixer or a magnetic stirrer can be employed.

In the above-mentioned processes, dyed slurry is obtained. Dyed resin particles can be obtained from the slurry by any conventional methods. For example, dyed resin particles are separated from the slurry by filtration. The organic solvent, surfactant and dye assistive are entrained in the filter cake and they are washed with a hydrocarbon with a low boiling temperature such as n-pentane, n-hexane, iso-hexane and the like. It is important not to use a polar organic solvent such as methanol, propanol or isobutanol for the washing since the cake tends to agglomerate upon exposure to such a solvent. The washed particles are then dried at a temperature below the glass transition temperature of the resin, or under reduced pressure. The thus obtained toner particles have substantially the same particle size distribution and the surface texture as those of the original resin particles.

In the present invention, in order to improve the triboelectric charging characteristics of the toner, charge control agents ("CCA") which are conventionally known in this field can be contained in the toner particles. Suitable charge control agents may be the negative-type or the positive-type. Several such CCAs are commercially available such as, for example, the Bontrone® E-88 brand CCA (a negative charge control agent which is an aluminum compound, available from Orient Chemical Corporation, Springfield, N.J.) and the Bontrone P-53 brand CCA (a positive CCA, also available from Orient Chemical Corporation). Other suitable CCAs can be selected for incorporation into the particulate resin compositions of the present invention. Examples include quaternary ammonium compounds inclusive of alkyl pyridinium halides, alkyl pyridinium compounds, reference U.S. Pat. No. 4,298,672, the disclosure of which is incorporated herein by reference; organic sulfate and sulfonate compositions, see U.S. Pat. No. 4,338,390, the disclosure of which is also incorporated herein by reference: bisulfonates; ammonium sulfates (DDAES); distearyl dimethyl ammonium bisulfate (DDAMS), see U.S. Pat. No. 5,114,821, the disclosure of which is likewise incorporated herein by reference; cetyl pyridinium tetrafluoroborates; distearyl dimethyl ammonium methyl sulfate, aluminum salts, such as BONTROL E84™ (oriental Chemicals); quaternary ammonium nitrobenzene sulfonates; and mixtures of charge enhancing additives, such as DDAMS and DDAES, for example. Such processes as dry mixing, solvent coating, spray coating and like may be used.

In the inventive process, a CCA is dissolved in an organic solvent mixture, specially prepared to prevent agglomeration of the dyed resin particles during CCA application, and either the dyed resin particles are immersed in the CCA solution at an elevated temperature conducive for diffusing-in of the CCA into the central portion of the particles or the solution is sprayed onto the dyed particles.

Subsequently, the organic solvent is removed by drying, whereby the CCA is caused to stay in the central portion of the toner particles or on the surface of the toner particles, respectively. It is preferable that the solvent mixture used for the CCA application is the same solvent mixture used in the aforementioned dyeing process.

In the present invention, it is preferable that the amount of the CCA is 0.1 to 10 parts by weight to 100 parts by weight of the dyed resin particles for appropriately controlling the triboelectric charging characteristics of the toner particles and image fixing performance, although the above ratio can be varied, depending upon the charge quantity required for the toner particles or a development means for use with the toner particles.

The CCA-containing particles may then be coated with a suitable flowability improvement agent. They generally help to enhance the flowability of the particles during their use as color toner. Suitable flow agents are materials such as finely-divided particles of hydrophobic silica, titanium oxide, zinc stearate, magnesium stearate and the like which may be applied by processes such as, for example, dry mixing, solvent mixing and the like. In a typical process, a hydrophobic fumed silica (previously treated with a surface activating reagent such as, for example, hexamethyidisilazane and available under the trade name Cab-O-Sil® T-530 from Cabot Corporation, Tuscola, Ill.) is mixed with the CCA-coated particles and blended well in a tumble mixer for about 10–60 minutes to obtain flow agent-coated toner particles.

In many color toner applications, the toner particles are used as a developer which typically contains the dyed particles as described above (containing the CCA and the flow agent) and a suitable carrier agent (such as, for example, ferrites, steel, iron powder and the like, optionally containing a surface treating coating agent thereon) are mixed together intimately to form the developer.

The features of the present invention will become apparent in the course of the following description of examples, which are given for illustration of the invention and are not intended to be limiting thereof.

EXAMPLES

Example 1

Preparation of a Cationically Dyeable Polyester Resin Particles

A cationically dyeable polyester resin was prepared by a melt condensation process. Into a 10-liter glass reaction vessel fitted with a paddle-type stirrer and a 20 cm fractionating column, dimethyl terephthalate (941 grams, 4.85 moles), dimethyl isophthalate (970 grams, 5.0 moles), sodium salt of dimethyl 5-sulfoisophthalate (44.4 grams, 0.15 moles), and 1,2 propylene glycol (1520 grams, 20 moles) were charged. Further, 1.4 grams of titanium tetraisopropoxide and 5.0 grams of IRGANOX 1010 (available from Clariant Corporation, East Hanover, N.J.) were added as the ester exchange catalyst. The reactants were charged at ambient temperature and purged with argon gas for about 1 hour. The reactant mixture was then heated to 150° C. with the stirrer on at 50 rpm to form a homogeneous melt. Subsequently, the reaction mixture is heated from 150° C. to 200° C. under a flowing argon atmosphere over 4 hours and maintained at 200° C. until approximately 340 ml of distillate was collected.

The reaction mixture was then slowly heated to 210° C. in about 30 minutes and was maintained at the temperature for one hour while under agitation of 50 rpm. The agitator speed was then lowered to 30 rpm and the reactor was put under a vacuum of 0.5 torr for one hour. Subsequently, the vacuum was released with argon and the reactant cooled downed to about 150° C. The content of the reactor was poured onto glass plates and allowed to cool down to ambient temperature. Approximately 2050 grams of polyester resin was obtained.

The glass transition temperature of thus prepared polyester resin was 61° C. The number average molecular weight was 5500 and the weight average molecular weight of the polyester 11200 with the polydispersity of 2.1. The molecular weight was determined by the gel permeation chromatography (GPC) using polystyrene as molecular weight standard.

Into a 5-1 round bottom flask equipped with a stirrer and a condensing column, 1500 grams of the polyester resin and 450 grams of N,N-dimethylformamide was charged. The content was heated to 150° C. and maintained at the temperature for 20 minutes under a total reflux condition. When the mixture attained fluidity, the stirrer was set at 30 rpm. Then, the stirrer speed was raised to 100 rpm and maintained at the speed for one hour to thoroughly mix the resin and the additives.

Subsequently, 1500 grams of 1:1 mixture of Isopar-L® and Isopar-V® (paraffinic solvents available from Exxon Chemical Company, Houston, Tex.) and 150 grams of Ganex V-220 (a non-ionic surfactant available form ISP Corporation, Wayne, N.J.) were charged into the flask. The content turned into a milky dispersion. The dispersion was maintained at the temperature and the stirring speed for 7 hours with the column set at a partial reflux condition. A particulate resin sample was collected and the particle size was determined. The resin particles had the volume average diameter of 4.5 micron and the span of 0.9. The content was allowed to cool down to ambient temperature. Then, 1000 grams of iso-hexane was charged into the flask and the content was stirred for 1 hour. Resin particles were separated from the liquid by filtration. The resin particles were re-dispersed in iso-hexane and filtered twice. The resin particles were then vacuum-dried at 40° C. for 10 hours to obtain approximately 1400 grams of dry polyester particles.

The volume average diameter of the resin particles was 4.7 microns and the span was slightly reduced to about 0.85. Scanning electron microscopy examination of the resin particles showed that the particles were substantially spherical with a rough surface texture. The surface roughness index was determined to be about 2.1 from the BET isotherm measurement.

Example 2

Cyan Polyester Toner

Into a 250-ml flask equipped with an impeller-type agitator, 48 grams of polyester resin particles of Example 1, 72 grams of Isopar-L®, and 12 grams of Genapol 26-L-1 were charged. The mixture was agitated at 100 rpm speed. The temperature was raised to 50° C. and maintained at the temperature for 30 minutes. Then 5 grams of ethanol as the dyeing assistive and 0.56 gram of Astrazon® Blue BG 200 (a CI Basic Blue 3 dye available from DyStar L. P., Charlotte, N.C.) were added to the mixture. The dyeing mixture was maintained under the condition. The particles were sampled to determined the optical absorbance using a spectrophotometer at different intervals. After 60 minutes of dyeing, the absorbance reached a limiting value, indicating that the dyeing is complete. Subsequently, 0.72 g of Bontron® E-84 (a negative charging charge control agent based on a zinc salt available from Orient Chemical Corporation of America, Springfield, N.J.) was added into the dyeing mixture. The temperature of the mixture was raised and maintained at 70° C. for additional 30 minutes to effect diffusion of the charge control agent into the particles. The mixture was then allowed to cool down to ambient temperature. The dyed particles were separated from the dyeing medium by filtration. The entrained solvent in the filter cake was washed off by dispersing the filter cake in iso-hexane and filtered again. The procedure was repeated three times. 100 parts by weight of the dry particles were blended with 2 parts by weight of Cab-O-Sil® TG-308F (a fumed silica acting as a flowability improvement aid from Cabot Corporation, Tuscola, Ill.) for 15 minute in a roll mill, whereby Cyan Toner No. 1 was obtained.

When the particle size was determined, the volume average particle size of 4.7 microns and the span value of 0.85 were essentially unchanged. Scanning electron microscopy examination of the toner particles showed that the particles were spherical with a micro-serrated surface texture. The surface roughness index was determined to be about 1.9 from the BET isotherm measurement.

Example 3

Cyan Polyester Toner Using a Larger Amount of Dyeing Assistive

The procedure of Example 2 was repeated with the exception that the amount of Ganex V-220 was increased to 50 g and the amount of ethanol to 10 g. The increased amount of ethanol accelerated the dyeing process substantially and the dyeing was complete in about 30 minutes. Cyan Toner No. 2 was thus obtained. The volume average diameter of the finished toner particles was 4.8 microns and the span 0.9. Scanning electron microscopy examination of the toner particles showed that the particles were substantially spherical with micro-serrated surface texture. The surface roughness index was 2.1.

Example 4

Cyan Polyester Toner Using Acetone as the Dyeing Assistive

The procedure of Example 3 was repeated with the exception that the 10 g of ethanol were replaced with 10 g of acetone. Cyan Toner No.3 was thus obtained. The volume average particle size was 4.8 micron and the span 0.9. The toner particles were substantially spherical with micro-serrated surface texture. The surface roughness index was 2.1.

Example 5

Magenta Toner

The procedure of Example 2 is repeated with the exception that 0.9 grams of Red Violet 3RA (a CI Basic violet 16 dye from Clariant Corporation, Charlotte, N.C.) in place of Astrazon® Blue BG 200. Magenta Toner No. 1 is thus obtained. The volume average diameter of the articles is 4.8 micron and the span 0.8. Scanning electron microscopy examination of the toner particles shows that the particles are substantially spherical with micro-serrated surface texture. The surface roughness index is 1.9.

Example 6

Yellow Toner

The procedure of Example 2 is repeated except that 0.72 grams of Zhejiang Cationic Yellow 4GL (a CI Basic Yellow 51 dye from Zhejiang Textiles Corporation, Shanghai, China) in place of Astrazon® Blue BG 200. Yellow Toner No. 1 is thus obtained. The volume average diameter of the toner particles is 4.8 micron and the span 0.75. Scanning electron microscopy examination of the toner particles shows that the particles are substantially spherical with micro-serrated surface texture. The surface roughness index is 1.95.

Comparative Example 1: Preparation of Polyester Toner without a Dyeing Assistive The procedure of Example 2 was repeated with the exception that no ethyl alcohol was charged into the dyeing mixture in order to prepare Cyan Toner No. 4. Pale blue particles were obtained, indicating that an effective dyeing could not be conducted at 50° C. The volume average diameter of the toner particles was 4.7 micron and the span 0.80. Scanning electron microscopy examination of the toner particles showed that the particles were substantially spherical with micro-serrated surface texture. The surface roughness index was 1.95.

Comparative Example 2: Preparation of Polyester Toner Without a Dyeing Assistive The procedure of Example 2 was repeated with the exception that no ethyl alcohol was charged and the dyeing was carried out 90° C. to prepare Cyan Toner No. 5. Dark blue particles were obtained, indicating that dyeing was efficaciously completed at 90° C. The volume average diameter of the toner particles was 4.9 micron and the span 0.9. Scanning electron microscopy examination of the toner particles showed that the particles were substantially spherical with smooth surface texture. The surface roughness index was 1.10. The irregular surface texture apparently becomes unstable at the high dyeing temperature.

Example 7

Preparation of an Acid-functionalized Styrene/acrylate Copolymer Resin Particles Into a 2-1 round bottom flask equipped with a stirrer and a condensing column, 738 grams of styrene, 180 grams of n-butyl acrylate, 39 grams of acrylic acid and 45 grams of 2,2'-azobisisobutylonitrile were charged at ambient temperature. The mixture was bubbled with argon for 30 minutes. Then temperature of the mixture was raised to 69° C. under stirring at 50 rpm. Polymerization ensued while the mixture was refluxed for 16 hours under argon atmosphere.

After the dispersion was cooled to ambient temperature, polymer particles were separated. The polymer particles were washed with a mixture of 80% by weight methanol and 20% by weight water three times and vacuum dried at 50° C. for 16 hours. About 700 grams of polymer resin was obtained.

The resulting polymer has the number average molecular weight of 16,000 and weight average molecular weight of 53,000. The glass transition temperature was 62° C.

Into a 1-1 round-bottom flask equipped with an impeller-type agitator and a condenser, 150 grams of the acid-functionalized styrene-acrylate copolymer resin of Example 8 and 90 grams of tetrahydofuran as the processing aid component were charged at ambient temperature. The content was agitated to form a mixture and then heated to 50° C. under a total reflux condition. The resin mixture was maintained at the temperature under an agitation of 50 rpm impeller rotation for 60 minutes after which it had attained a sufficient fluidity.

Subsequently, 150 grams of poly-(ethylene oxide) as the immiscible solvent component and 7.5 grams of sodium dodecylsulfate as the surfactant were charged into the flask which contained the resin composition and was maintained under agitation at 50° C. After completing the charging, the mixture was further maintained at the temperature under an increased shearing of 100 rpm impeller rotation. The mixture turns opalescent in appearance after about 10 minutes at which point the condenser was adjusted to a partial reflux condition. After 2 hours of shearing at 50° C., the temperature of the content of the flask was raised to 80° C. to expedite the evaporation of tetrahydrofuran. The content was maintained at the shearing condition until the vapor effluent stopped showing a trace of tetrahydrofuran and the dispersion was allowed to cool down to the ambient temperature. The comminuted resin particles were separated from the solvent using a filtration process. The solvent medium entrained in the filter cake was washed off by re-dispersing the filter cake in water and re-filtering three times. The re-filtered particles were vacuum-dried at 60° C. for 10 hours to obtain about 130 grams of dry resin particles.

The resulting particulate styrene-acrylate composition had the volume average particle diameter of 6.8 microns and the span of 0.7. Scanning electron microscopy examination of the resin particles showed that the particles were substantially spherical with a coarse surface texture. The surface roughness texture of the resin particles as determined by the BET isotherm methods was 2.2.

Example 8

Preparation of Dyed Styrene/acrylate Copolymer Toner

Into a 250-ml flask equipped with an impeller-type agitator, 48 grams of the styrene/acrylate copolymer resin particles of Example 7, 60 grams of tetrahydofuran, and 8 grams of sodium dodecylsulfate 26-L-1 were charged. The agitator was set at 50 rpm. The temperature was raised to 50° C. and maintained at the temperature for 30 minutes. Then 5 grams of ethanol as the dyeing assistive and 0.56 gram of Astrazone® Blue BG 200 were added to the mixture. After 60 minutes of dyeing, the absorbance reached a limiting value, indicating that the dyeing is complete. Subsequently, 0.72 g of Bontron® E-84 was added into the dyeing mixture. The temperature of the mixture was raised and maintained at 70° C. for additional 30 minutes to incorporate the charge control agent into the particles. After cooling, the dyed particles were separated from the dyeing medium by filtration. The entrained solvent in the filter cake was washed off by dispersing the filter cake in iso-hexane and filtered again. 100 parts by weight of the dry particles were blended with 2 parts by weight of Cab-O-Sil® TG-308F for 15 minute in a roll mill, whereby Cyan Toner No.6 was obtained.

When the particle size was determined, the volume average particle size of 6.9 microns and the span value of 0.68 were essentially unchanged. Scanning electron microscopy examination of the toner particles showed that the particles were spherical with a micro-serrated surface texture. The surface roughness index was determined to be about 2.0 from the BET isotherm measurement.

Example 9

Toner Evaluation

The triboelectric charge of the toners described above was determined by a blow-off type electric charge measuring apparatus (Vertex Charge Analyzer supplied by Vertex Image Products, Yukon, Pa.) equipped with a Faraday cage and an electrometer as described below. First, a developer was prepared by blending a toner and a carrier (Type 22 Carrier, copper-zinc ferrite granules coated with a fluoropolymer, supplied by Vertex Image Products) at a ratio of about 2 parts by weight of toner to 100 parts by weight of the carrier. The developer was placed in a glass jar and rolled at 10 rpm for 10 minutes using a roll mill. Approximately 1.5 g of the rolled developer was placed in a Faraday cage and the toner particles were blown out of the Faraday cage using an air stream from a nozzle. The up-stream air pressure was typically about 80 $kN/m^2$. Charge induced on the Faraday cage due to the blow-off of charged toner particles for 60 seconds was defined as the toner charge. The charge per unit mass of toner was obtained by dividing the toner charge by the amount of toner blown-off from the Faraday cage.

Optical absorption density of the toners was determined from the optical absorption spectra of the tones in solution. In the method, the toner was dissolved in hexafluoroisopropanol at a concentration of 1 gram per liter of the solvent and the absorption spectra of the toner solution was determined in the wavelength range of 350–800 nm using a Lambda-19 spectrophotometer (available from Perkin Elmer Corporation, Norwalk, Conn.). The solution absorbance (A) was defined as the logarithm of the ratio of intensities of incoming and outgoing optical beams at he peak absorption wavelength when the path length through the solution sample was 1 cm. The solution absorbance was then converted to the image color density (B) per unit thickness of a printed film using the formula:

$$B=A*(\rho*d'/c*d)$$

where c is the toner concentration (in grams per liter) in the solution, d' the film thickness which is set to 1 micron, ρ the density of the toner resin (=1.2 $g/cm^3$) and d the path length through the solution (in centimeters). Numerically, the formula then becomes:

$$B(\mu m^{-1})=0.12*A(cm^{-1})$$

The results for the toner samples in the examples are listed the table below. The data of Examples 2 and Counter Example 1 showed that, with the addition of a dyeing assistive, high up-take of dye was obtained even at a temperature as low as 50° C. Also, comparison of the results of Example 2 and Counter Example 2 showed that high uptake of dye was possible without dyeing assistive but at a much high temperature of 90° C. However, the high temperature processing produced toner particles with a smooth surface texture and the toner, in turn, exhibited a lower triboelectric charge value compared to the toner with a micro-serrated surface texture.

| Toner | Resin | Charge ($\mu$C/g) | Color density ($\mu m^{-1}$) |
|---|---|---|---|
| Cyan 1 (Example 2) | Polyester | −50 | 0.22 |
| Cyan 2 (Example 3) | Polyester | −47 | 0.24 |
| Cyan 3 (Example 4) | Polyester | −49 | 0.23 |
| Cyan 4 (Co. Examp. 1) | Polyester | −40 | 0.04 |

-continued

| Toner | Resin | Charge ($\mu$C/g) | Color density ($\mu m^{-1}$) |
|---|---|---|---|
| Cyan 5 (Co. Examp. 2) | Polyester | −35 | 0.24 |
| Cyan 6 (Example 8) | Styrene-acrylate copolymer | −15 | 0.20 |

Figure 2:
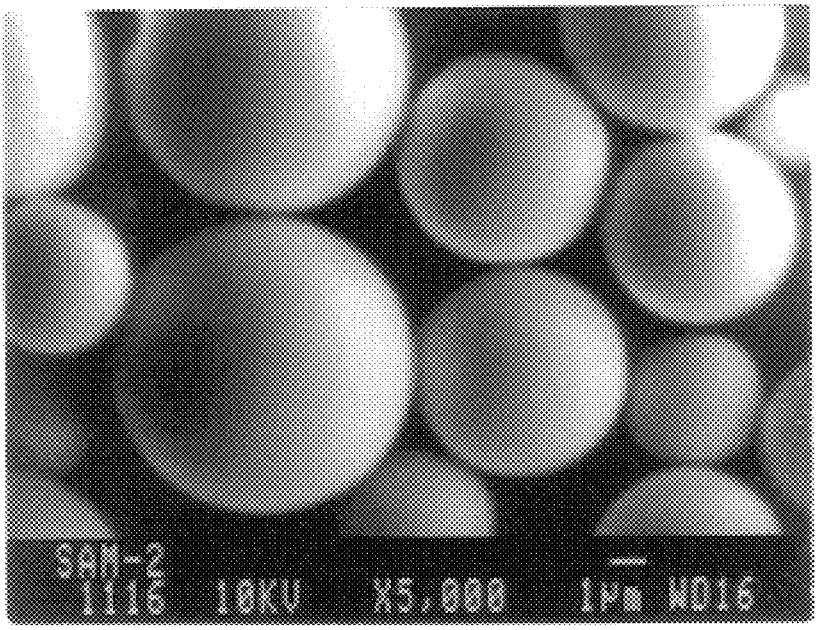
FIG. 2 is a scanning electron micrograph of a toner composition of which particles have smooth surface texture, produced by dispersion dyeing at 90° C. in the absence of any dyeing assistive.
Figure 3:
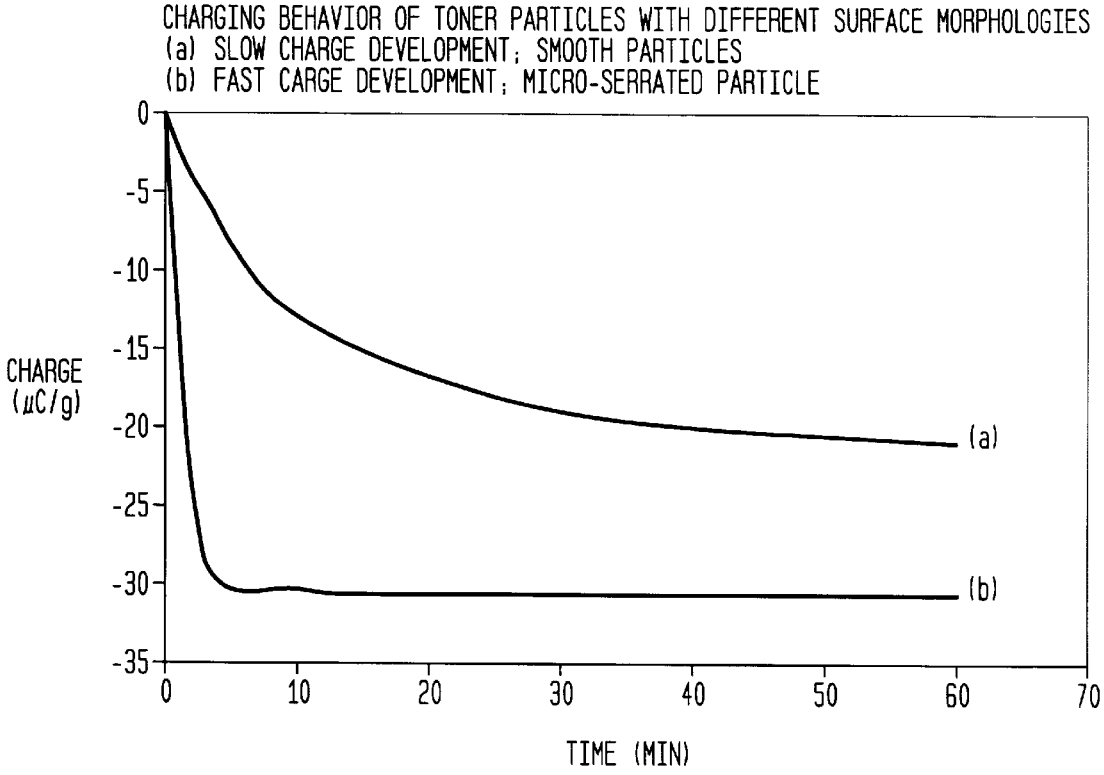
FIG. 3 is a plot of triboelectric charge development as a function of toner-carrier mixing time. The data demonstrates that the micro-serrated surface texture promotes rapid charge development.

FIG. 1 is a photomicrograph (5000×) of a dyed toner composition of the invention having toner particles provided with a micro-serrated surface texture, whereas FIG. 2 is a photomicrograph of a dyed toner composition (also 5000×) having particles with a smooth surface texture. In order to better understand the effects of toner surface texture on the triboelectric charging behavior, the charge of two toner compositions (Cyan 1 with micro-serrated surface textured particles and Cyan 5 with smooth surface textured particles) were determined as a function of the toner-carrier mixing time. The results are shown in FIG. 3 that clearly show toner particles with rough surface texture develop triboelectric charge much faster than the toner particles with smooth surface texture.

The invention has been described in detail in connection with numerous embodiments; however modifications to those embodiments will be readily apparent to those of skill in the art. For example, while the inventive process has been described in connection with a paraffin medium, other media which are stable to the required temperatures may be substituted. Such modifications are within the spirit and scope of the present invention which is set forth in the appended claims.

What is claimed is:

1. A color toner composition consisting essentially of polyester resin dyed particles having a volume average diameter in the range of from about 2 microns to about 10 microns, with a size distribution span value less than 1.0 and characterized by a micro-serrated surface texture exhibiting a surface roughness index value larger than about 1.2, wherein the surface roughness index is determined by the formula:

$$\text{surface roughness index}=(1/6)\rho d_v A_{exp}$$

where ρ is the density of the resin, $d_v$ is the volume average diameter of the resin particles and $A_{exp}$ is the surface area of 1 gram of the particulate composition as measured by the BET isotherm method.

2. The color toner composition according to claim 1, wherein said dyed toner resin particles have a micro-serrated surface exhibiting a surface roughness index of greater than about 1.5.

3. The color toner composition according to claim 2, wherein said dyed toner resin particles have a micro-serrated surface exhibiting a surface roughness index of greater than about 2.

4. The color toner composition according to claim 1 wherein said resin particles include functional sites suitable for interacting with a functionalized dye selected from the group consisting of: hydroxy moieties; alkoxy moieties; sulfonic or derivatized sulfonic moieties; carboxyl or derivatized carboxyl moieties; phosphonic or derivatized phosphonic moieties; phosphinic or derivatized phosphinic moieties; thiol moieties; amine moieties; alkaline moieties; quaternized moieties; and mixtures thereof.

5. The color toner composition according to claim 1, wherein said toner comprises resin particles are substantially spherical with a volume average particle size of from about 3 to about 8 microns.

6. The color toner composition according to claim 1, wherein said toner resin particles have a narrow size distribution with a span value less than about 0.8.

7. The color toner composition according to claim 1 wherein said toner resin particles include a charge control agent selected from the group consisting of: quaternary ammonium compounds; organic sulfate and sulfonate compositions; bisulfonates; ammonium sulfates (DDAES); distearyl dimethyl ammonium bisulfate (DDAMS); cetyl pyridinium tetrafluoroborates; distearyl dimethyl ammonium methyl sulfate, aluminum salts; quaternary ammonium nitrobenzene sulfonates; and mixtures thereof.

8. The color toner composition according to claim 7, wherein said charge control agent comprises a quaternary ammonium compound.

9. The color toner composition according to claim 8, wherein said quaternary ammonium compound is an alkyl pyridium compound.

10. The color toner composition according to claim 9, wherein said quaternary ammonium compound is an alkyl pyridium halide.

11. A developer composition incorporating the color toner composition according to claim 1 and further comprising carrier particles, wherein said carrier particles are selected from the group consisting of ferrite particles, steel particles and iron particles having a surface active agent coated thereon.

* * * * *